US011586139B2

(12) United States Patent
Noguchi

(10) Patent No.: US 11,586,139 B2
(45) Date of Patent: Feb. 21, 2023

(54) OPENING-CLOSING MEMBER OF IMAGE FORMING APPARATUS AND IMAGE FORMING APPARATUS

(71) Applicant: FUJIFILM Business Innovation Corp., Tokyo (JP)

(72) Inventor: Kotaro Noguchi, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/410,380

(22) Filed: Aug. 24, 2021

(65) Prior Publication Data

US 2022/0365477 A1 Nov. 17, 2022

(30) Foreign Application Priority Data

May 12, 2021 (JP) ..... JP2021-081177

(51) Int. Cl.

| | |
|---|---|
| ***G03G 21/00*** | (2006.01) |
| ***G03G 21/16*** | (2006.01) |
| *G03G 21/18* | (2006.01) |
| *G03G 15/16* | (2006.01) |

(52) U.S. Cl.
CPC ..... *G03G 21/1633* (2013.01); *G03G 15/161* (2013.01); *G03G 21/185* (2013.01); *G03G 2221/169* (2013.01)

(58) Field of Classification Search
CPC ..... G03G 21/1633; G03G 2221/169
USPC ..... 399/107, 124
See application file for complete search history.

(56) References Cited

U.S. PATENT DOCUMENTS

| | | | | |
|---|---|---|---|---|
| 4,754,293 | A * | 6/1988 | Aizawa | G03G 15/30 399/361 |
| 5,160,964 | A * | 11/1992 | Takahashi | G03G 21/1817 399/113 |
| 10,976,694 | B2 | 4/2021 | Hyodo et al. | |
| 2005/0214022 | A1* | 9/2005 | Umeyama | G03G 21/1619 399/107 |
| 2008/0286000 | A1* | 11/2008 | Kimizuka | G03G 21/1647 399/111 |
| 2011/0142490 | A1* | 6/2011 | Kikuchi | G03G 21/12 399/111 |
| 2016/0349667 | A1* | 12/2016 | Imaizumi | G03G 21/1633 |
| 2019/0227479 | A1* | 7/2019 | Suzuki | G03G 21/1647 |

FOREIGN PATENT DOCUMENTS

| | | |
|---|---|---|
| JP | 08-234521 A | 9/1996 |
| JP | 2002-341726 A | 11/2002 |
| JP | 2020-134543 A | 8/2020 |

* cited by examiner

*Primary Examiner* — Robert B Beatty
(74) *Attorney, Agent, or Firm* — Sughrue Mion, PLLC

(57) ABSTRACT

An opening-closing member of an image forming apparatus includes: an external opening-closing member that configurates a part of an outer surface of the image forming apparatus and that is openable and closable; an internal opening-closing member that faces an inner surface of the external opening-closing member and that is openable and closable together with the external opening-closing member; and a container that defines a containment space by protruding from the internal opening-closing member toward the external opening-closing member and that enables a member contained in the containment space to be taken out when the external opening-closing member and the internal opening-closing member are opened.

12 Claims, 13 Drawing Sheets

OPENING-CLOSING MEMBER OF IMAGE FORMING APPARATUS AND IMAGE FORMING APPARATUS

CROSS-REFERENCE TO RELATED APPLICATIONS

This application is based on and claims priority under 35 USC 119 from Japanese Patent Application No. 2021-081177 filed May 12, 2021.

BACKGROUND

(i) Technical Field

The present disclosure relates to an opening-closing member of an image forming apparatus and the image forming apparatus.

(ii) Related Art

Japanese Unexamined Patent Application Publication No. 2002-341726, for example, discloses an electrophotographic image forming apparatus that includes an electrophotographic image forming member that uses powder toner as a developer, a housing that contains the image forming member, and a covering that opens or closes an opening formed in the housing and that includes a reinforcement rib on a back surface, in which a part of the rib on the back surface of the covering is removed and flattened into a non-rib portion.

SUMMARY

There is a risk that the product quality of the apparatus is reduced due to low rigidity of an external opening-closing member that configurates a part of an outer surface of the image forming apparatus and that is openable and closable. However, there is a risk that a sunken mark appears and detracts from the appearance of the external opening-closing member due to increased rigidity of the external opening-closing member reinforced, for example, by adding the reinforcement rib into the external opening-closing member and by increasing the height of the reinforcement rib, and that the product quality of the apparatus is reduced.

Aspects of non-limiting embodiments of the present disclosure relate to inhibition about reducing the product quality of an apparatus due to an external opening-closing member unlike the case where the rigidity of the external opening-closing member is increased by adding or strengthening a reinforcement rib.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an opening-closing member of an image forming apparatus including: an external opening-closing member that configurates a part of an outer surface of the image forming apparatus and that is openable and closable; an internal opening-closing member that faces an inner surface of the external opening-closing member and that is openable and closable together with the external opening-closing member; and a container that defines a containment space by protruding from the internal opening-closing member toward the external opening-closing member and that enables a member contained in the containment space to be taken out when the external opening-closing member and the internal opening-closing member are opened.

BRIEF DESCRIPTION OF THE DRAWINGS

An exemplary embodiment of the present disclosure will be described in detail based on the following figures, wherein:

FIG. 2A illustrates a perspective view of the exposure device, and FIG. 2B illustrates a sectional view taken along line IIB-IIB in FIG. 2A;

FIG. 5A illustrates an exploded perspective view of the opening-closing covering viewed in front of an exterior covering, and FIG. 5B illustrates an exploded perspective view of the opening-closing covering viewed in front of an interior covering;

FIG. 8A illustrates a front view, and FIG. 8B and FIG. 8C illustrate enlarged perspective views of parts in FIG. 8A;

FIG. 10A illustrates a state in which the hard key does not interfere with a rotation handle, and FIG. 10B illustrates a state in which the hard key interferes with the rotation handle;

DETAILED DESCRIPTION

An exemplary embodiment of the disclosure will hereinafter be described in detail with reference to the drawings.

Entire Configuration of Image Forming Apparatus 1

Figure 1:
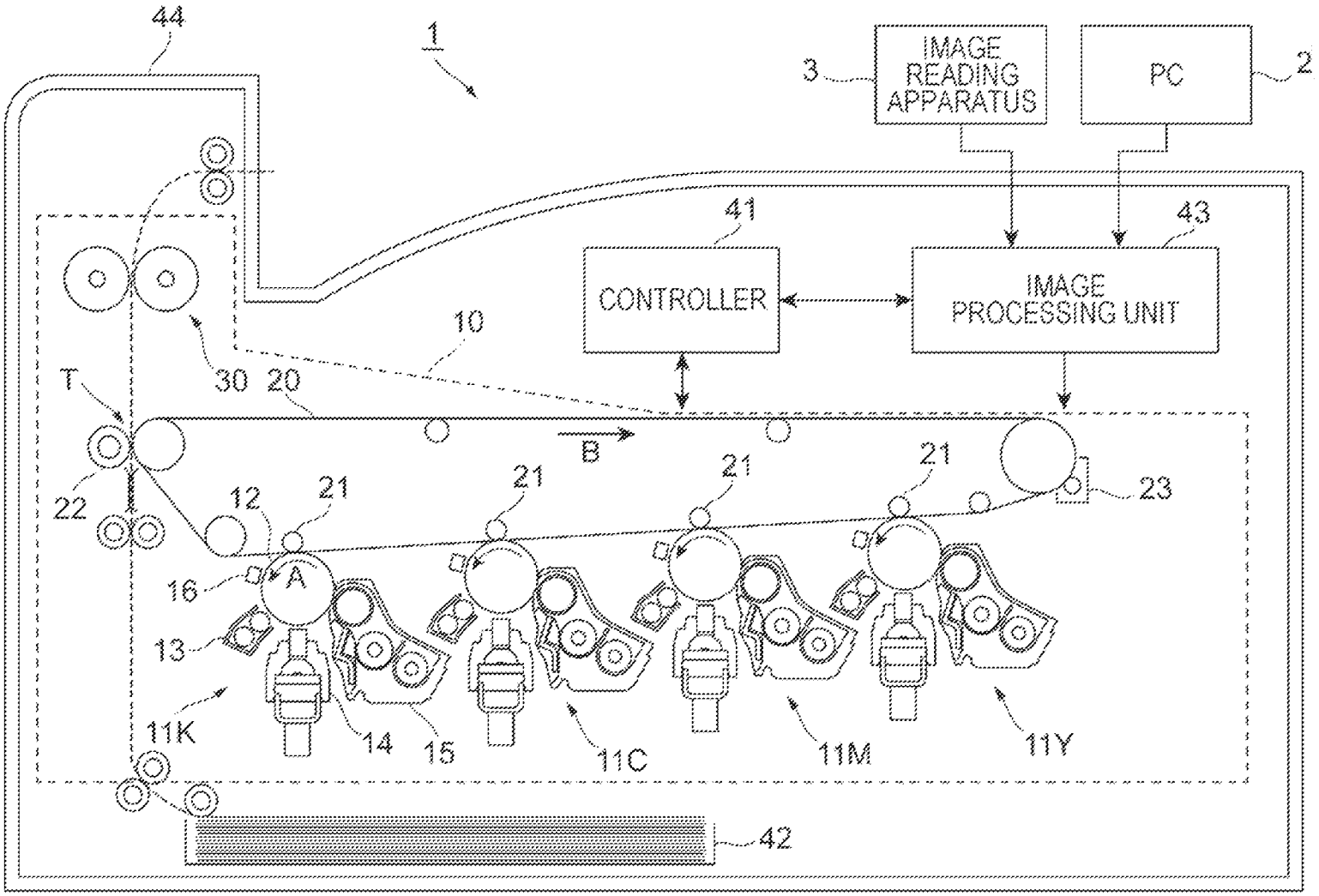
FIG. 1 illustrates the entire configuration of an image forming apparatus according to the present exemplary embodiment.

FIG. 1 illustrates the entire configuration of an image forming apparatus 1 according to the present exemplary embodiment.

The image forming apparatus 1 is an image forming apparatus typically called a tandem type. The image forming apparatus 1 includes an image forming member 10 that forms an image depending on image data in colors, a controller 41 that controls the entire operation of the image forming apparatus 1, and a sheet holding member 42 that holds sheets that are supplied to the image forming apparatus 1. The image forming apparatus 1 includes an image processing unit 43 that performs predetermined image processing on image data that is received from, for example, a personal computer (PC) 2 or an image reading apparatus 3.

The image forming apparatus 1 corresponds to an example of an image forming apparatus. The image forming member 10 corresponds to an example of an image forming member.

The image forming member 10 includes four image forming units 11Y, 11M, 11C, and 11K (also collectively referred to as "image forming units 11") that are arranged in parallel at regular intervals. Each image forming unit 11 includes a photoconductor drum 12 that forms an electrostatic latent image and that holds a toner image, a charging unit 13 that charges a surface of the photoconductor drum 12 at a predetermined potential, an exposure device 14 that exposes the photoconductor drum 12 that is charged by the charging unit 13 to light, based on the image data in colors, a development unit 15 that develops the electrostatic latent image that is formed on the photoconductor drum 12, and a drum cleaner 16 that cleans the surface of the photoconductor drum 12 after transfer.

The image forming units 11 are configured in the same manner except for toner that is contained in the development units 15 and form respective yellow (Y), magenta (M), cyan (C), and black (K) toner images.

The image forming member 10 also includes an intermediate transfer belt 20 to which the color toner images that are formed by the photoconductor drums 12 of the image forming units 11 are transferred by multi-layer transfer and first transfer rollers 21 for first transfer by which the color toner images that are formed by the image forming units 11 are sequentially transferred to the intermediate transfer belt 20. The image forming member 10 also includes a second transfer roller 22 for second transfer by which the color toner images that are superposed and transferred to the intermediate transfer belt 20 are collectively transferred to a sheet that is a recording material, a belt cleaner 23 that cleans a surface of the intermediate transfer belt 20 after the second transfer, and a fixing device 30 that fixes the color toner images after the second transfer to the sheet.

In the image forming apparatus 1, the image forming member 10 performs the operation of forming the image, based on various control signals that are transmitted from the controller 41. That is, image processing on the image data that is inputted from the PC 2 or the image reading apparatus 3 is performed by the image processing unit 43 under control of the controller 41, and the image data is transmitted to the image forming units 11. In each image forming unit 11, the photoconductor drum 12 is charged by the charging unit 13 and is exposed to light by the exposure device 14, the electrostatic latent image is developed by the development unit 15, and the color toner image is formed on the surface of the photoconductor drum 12.

The color toner images that are formed on the photoconductor drums 12 are sequentially transferred to the intermediate transfer belt 20 by using the first transfer rollers 21.

A composite toner image on the intermediate transfer belt 20 is transported to a second transfer portion T corresponding to a region in which the second transfer roller 22 is disposed, with movement of the intermediate transfer belt 20. When the composite toner image is transported to the second transfer portion T, the sheet is fed from the sheet holding member 42 to the second transfer portion T with a timing with which the composite toner image is transported to the second transfer portion T. The composite toner image is electrostatically transferred to the transported sheet at once due to a transfer electric field that is formed at the second transfer portion T by using the second transfer roller 22.

Subsequently, the sheet to which the composite toner image is transferred is transported to the fixing device 30 and is subjected to a fixing process by using heat and pressure, and the toner image is fixed to the sheet. The sheet to which the toner image is fixed is transported to a sheet loader that is included in a discharge unit of the image forming apparatus 1.

The toner that is attached to the intermediate transfer belt 20 after the second transfer is removed from the surface of the intermediate transfer belt 20 by using the belt cleaner 23 after the end of the second transfer. In this way, the image forming apparatus 1 repeats the formation of the image the number of times of cycles for the number of prints.

The image forming member 10 includes a rotation handle 24 (see FIG. 3, or FIG. 10A and FIG. 10B) for a retracting operation that is an operation of retracting the intermediate transfer belt 20 from the photoconductor drum 12 of each image forming unit 11. The retracting operation is performed by the rotation handle 24 to remove a sheet that is jammed on a sheet transport path in the image forming apparatus 1.

Description of Exposure Device 14

The configuration of each exposure device 14 according to the present exemplary embodiment will now be described.

Figure 2A:
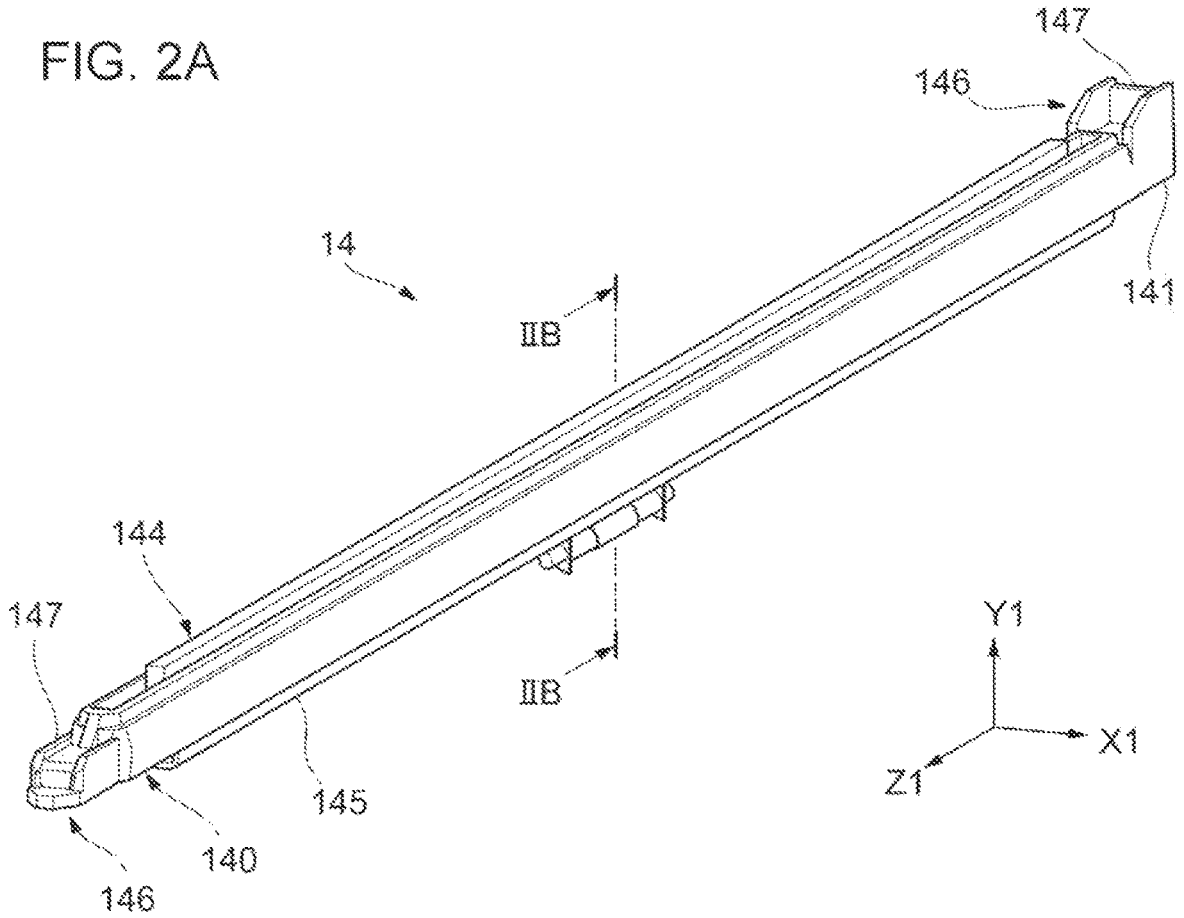
FIG. 2A and FIG. 2B illustrate an exposure device according to the present exemplary embodiment, where
Figure 2B:
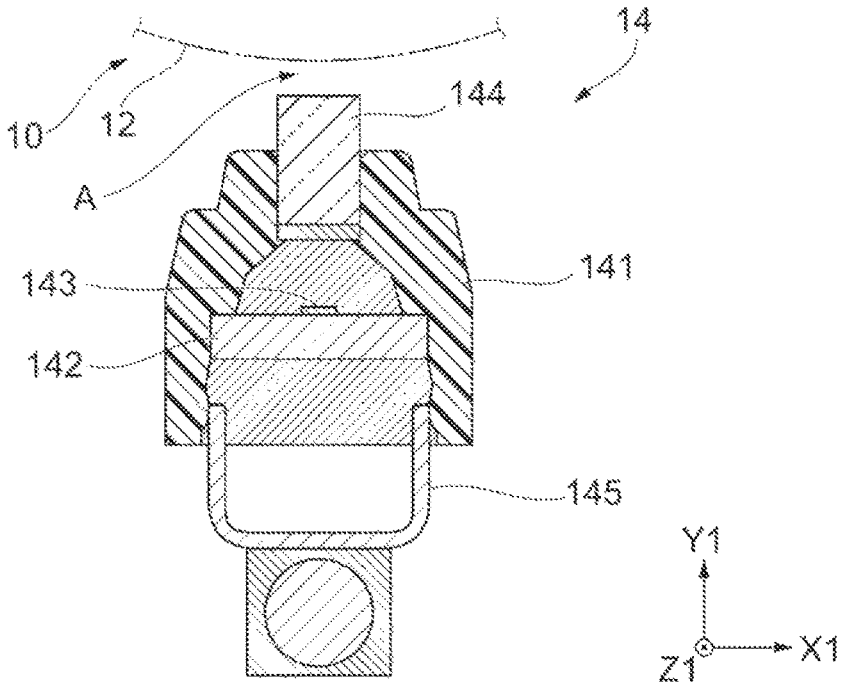

FIG. 2A and FIG. 2B illustrate the exposure device 14 according to the present exemplary embodiment. FIG. 2A illustrates a perspective view of the exposure device 14. FIG. 2B illustrates a sectional view taken along line IIB-IIB in FIG. 2A.

In the image forming apparatus 1 illustrated in FIG. 1, the exposure devices 14 are disposed below the photoconductor drums 12 in the vertical direction and expose the photoconductor drums 12 to light from below in the vertical direction. As illustrated in FIG. 2A, each exposure device 14 includes a light emitting diode (LED) print head (LPH) 140.

The LPH 140 includes a housing 141, a LED array 143 that includes multiple light-emitting elements, a LED circuit substrate 142 that includes, for example, a signal-generating circuit (not illustrated) that drives the LED array 143, a rod lens array 144 that images light emitted from the LED array 143 on the surface of the photoconductor drum 12, and a frame 145 that reinforces the housing 141. The LPH 140 includes first positioning portions 146 for positioning of the LPH 140 in an X1 direction with respect to the photoconductor drum 12 and second positioning portions 147 for positioning of the LPH 140 in a Y1 direction on both end portions of the photoconductor drum 12 in an axial direction.

In the following description, the direction of the optical axis (a direction in which light is emitted from the light-emitting elements of the LED array 143) of the rod lens array 144 of the LPH 140 illustrated in FIG. 2A is referred to as the Y1 direction in some cases. A principal scanning direction, that is, the axial direction of the photoconductor drum 12 (see FIG. 1) is referred to as a Z1 direction in some cases. A sub scanning direction, that is, the direction perpendicular to the Y1 direction and the Z1 direction is referred to as the X1 direction in some cases.

The housing 141 is composed of, for example, a resin material such as ABS and supports the LED circuit substrate 142 and the rod lens array 144.

The frame 145 is composed of, for example, a metal material such as steel or SUS and is mounted on the housing 141 opposite the rod lens array 144.

The rod lens array 144 is disposed in the Z1 direction that is the axial direction of the photoconductor drum 12 and has a width in the X1 direction that is a direction in which the photoconductor drum 12 moves. The rod lens array 144 is configured, for example, such that refractive index distribution lenses that form an erect, unmagnified image are arranged in the axial direction of the photoconductor drum 12. The rod lens array 144 images the light emitted from the LED array 143 on the surface of the photoconductor drum 12.

The LED array 143 is disposed on the LED circuit substrate 142. The LED array 143 is configured such that multiple LED chips that include respective light-emitting elements (LEDs) are arranged in the Z1 direction. Consequently, the multiple light-emitting elements are arranged on the LED circuit substrate 142 in the Z1 direction. The light-emitting elements are disposed so as to emit light toward the photoconductor drum 12 (the rod lens array 144) in the Y1 direction. As for the LED array 143 according to the present exemplary embodiment, the LED chips are in a staggered arrangement such that the positions of the light-emitting elements in the Z1 direction are on the boundaries between the adjacent LED chips.

In the case where each exposure device 14 is installed in the image forming apparatus 1, the first positioning portions 146 and the second positioning portions 147 are brought into contact with a container member (not illustrated) that contains and supports the photoconductor drum 12 in the image forming apparatus 1. More specifically, the first positioning portions 146 are brought into contact with the container member of the photoconductor drum 12 in the X1 direction, and the second positioning portions 147 are brought into contact with the container member of the photoconductor drum 12 in the Y1 direction.

Consequently, both ends of the LPH 140 in the Z1 direction are positioned with respect to the photoconductor drum 12 in the X1 direction and in the Y1 direction. The LPH 140 is located such that the distance between the rod lens array 144 of the LPH 140 and the photoconductor drum 12 is equal to the focal length of the rod lens array 144.

According to the present exemplary embodiment, a central portion of the LPH 140 in the Z1 direction, that is, a region that is interposed between the first positioning portions 146 and between the second positioning portions 147 that are disposed at both ends of the LPH 140 in the Z1 direction is not in contact with the photoconductor drum 12 and is away from the photoconductor drum 12.

In the description, the image forming apparatus 1 according to the present exemplary embodiment uses an electrophotographic system that transfers toner that is attached to a photoconductor member to a recording material to form an image but is not limited thereto. For example, an ink-jet method of discharging ink to a recording material to form an image may be used.

In the description described according to the present exemplary embodiment, the image forming apparatus 1 forms a color image but may be configured so as to form a black (K) toner image (a monochrome image) and so as not to form a color image.

Exterior Member of Image Forming Apparatus 1

An exterior member of the image forming apparatus 1 will now be described.

Figure 3:
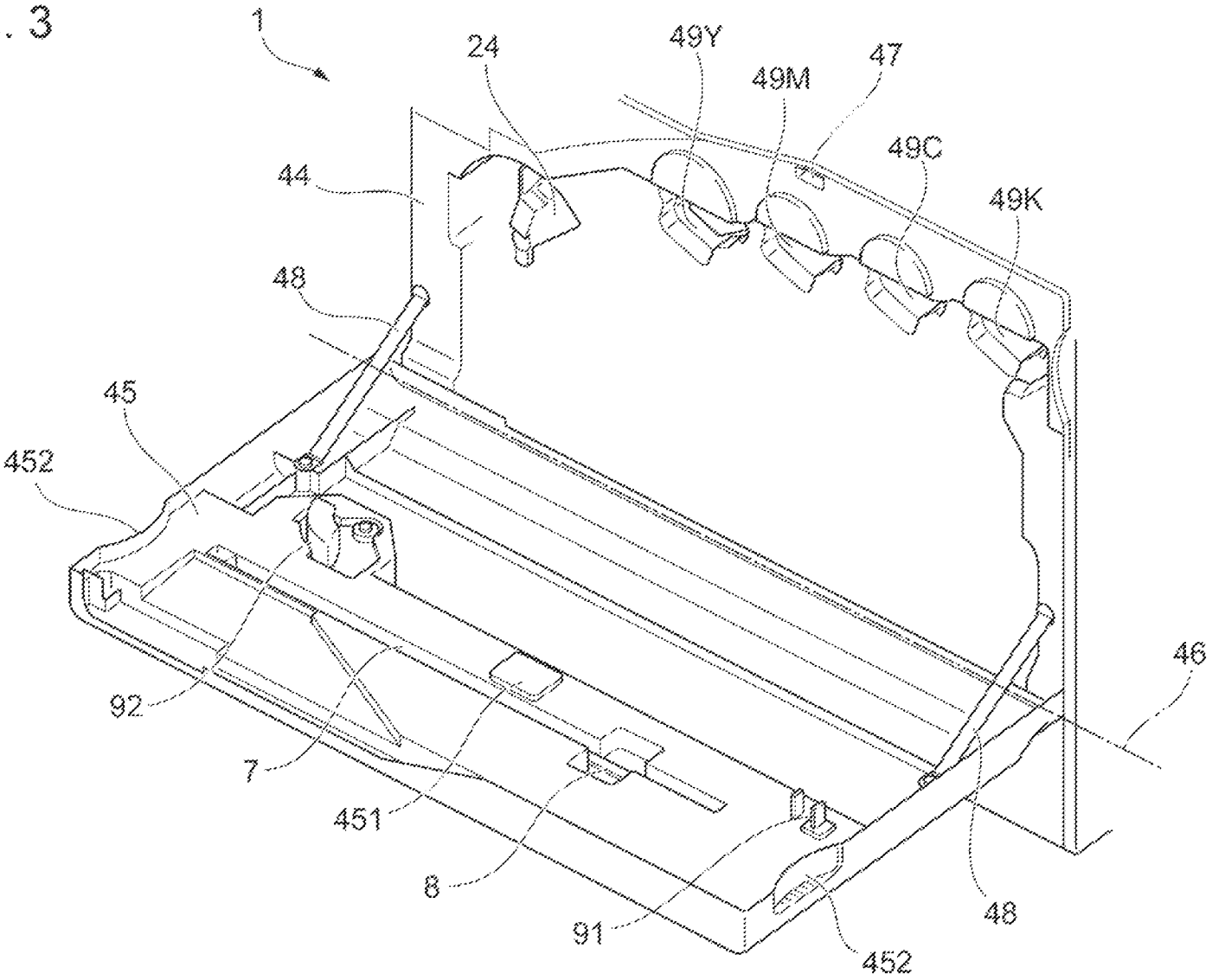
FIG. 3 illustrates a perspective view of an exterior member of the image forming apparatus.

FIG. 3 illustrates a perspective view of the exterior member of the image forming apparatus 1 and illustrates a state in which an opening-closing covering 45 is opened relative to a housing 44. An illustration of a part of an inner configuration of the image forming apparatus 1 is omitted.

As illustrated in FIG. 3, the image forming apparatus 1 includes the exterior member that includes the housing 44 and the opening-closing covering 45, the housing 44 uses multiple components to configurate a container body that contains components for performing various functions of the image forming apparatus 1, and the opening-closing covering 45 configurates an outer surface of the image forming apparatus 1 (referred to below as an "apparatus outer surface" in some cases) together with the housing 44 and is openable and closable relative to the housing 44. The opening-closing covering 45 described herein may be referred to as a front covering because the opening-closing covering 45 is located at the front of the image forming apparatus 1 and may be referred to as a maintenance covering because the opening-closing covering 45 is a member that is opened during maintenance of the image forming apparatus 1.

The opening-closing covering 45 corresponds to an example of an opening-closing member.

The "member" in the present disclosure is not limited to a member as a single component and may be a combination of multiple components.

A rotation center 46 about which the opening-closing covering 45 rotates relative to the housing 44 is near a lower portion, that is, the bottom surface of the image forming apparatus 1. The rotation center 46 is away from the upper surface of the image forming apparatus 1.

Above the rotation center 46, a magnet 47 is mounted on the housing 44, and an iron plate member 451 is mounted on the opening-closing covering 45. The magnet 47 and the iron plate member 451 are attracted and attached to each other due to magnetic force of the magnet 47. Consequently, a state in which the opening-closing covering 45 stands upright is maintained, and the opening-closing covering 45 is closed.

According to the present exemplary embodiment, the opening-closing covering 45 configurates a part of the outer surface of the image forming apparatus 1 with the opening-closing covering 45 closed.

The rotation center 46 is an example of a rotation center.

Both end portions of the housing 44 and the opening-closing covering 45 in the direction in which the rotation center 46 extends are connected to each other by using straps 48 composed of resin. More specifically, a first end of each strap 48 is screwed at a position on the housing 44 between the rotation center 46 and the magnet 47 in a direction intersecting the rotation center 46. A second end of each strap 48 is screwed at a position on the opening-closing covering 45 between the rotation center 46 and the iron plate member 451.

Consequently, when the opening-closing covering 45 is opened, tension is applied to the straps 48 due to the weight of the opening-closing covering 45, and the tilt of the opening-closing covering 45 is maintained without interfering with a surface on which the image forming apparatus 1 is disposed. Accordingly, when the opening-closing covering 45 is opened, the opening-closing covering 45 is supported by the two straps 48 and falls sideways.

The straps 48 are examples of a restriction member.

The opening-closing covering 45 includes handles 452 that are used when the opening-closing covering 45 is opened. The handles 452 have hollows at both end portions in the direction in which the rotation center 46 extends. A user may open the opening-closing covering 45 against the magnetic force by grabbing one of the two handles 452 of the opening-closing covering 45 with the hand or both of the handles 452 with the hands when the opening-closing covering 45 that is closed is opened.

The handles 452 are examples of portions that are used by a user.

The opening-closing covering 45 is closed in normal times and is opened during, for example, the maintenance. That is, opening the opening-closing covering 45 provides access to an inner portion of the image forming apparatus 1. For example, the sheet holding member 42 may be pulled out, and yellow (Y), magenta (M), cyan (C), and black (K) toner cartridges 49Y, 49M, 49C, and 49K (also collectively referred to as "toner cartridges 49") that contain toner that is supplied to the development units 15 of the image forming member 10 may be taken out. The toner cartridges 49 are detachably disposed on the housing 44 and are replaced when the amount of remaining toner is low.

Accordingly, the maintenance such as an operation of dealing with paper jam on the sheet transport path in the image forming apparatus 1 and an operation of cleaning the toner described later may be performed with the opening-closing covering 45 opened in addition to an operation of a refill of the sheet holding member 42 with sheets and an operation of replacement of the toner cartridges 49.

Each toner cartridge 49 may include a storage medium that is configurated by, for example, an electrically erasable and programmable ROM (EEPROM). In this case, the storage medium stores information that represents the kind of the toner cartridge 49 and information about the state of the use of the toner cartridge 49 such as the number of rotation of a rotation member (a rotation member that is used to transport the toner) that is disposed in the toner cartridge 49.

A container 7 is formed on the opening-closing covering 45. The container 7 is used to contain a cleaning rod 8 that is periodically used.

The cleaning rod 8 is used to clean the toner by being inserted into a space A (see FIG. 2B) between the photoconductor drums 12 (see FIG. 1) of the image forming member 10 and the exposure devices 14 in the Z1 direction (see FIG. 2A or FIG. 2B) with the opening-closing covering 45 opened.

The container 7 is an example of a container. The cleaning rod 8 is an example of a member contained in a containment space.

An interlock component 91 and a hard key 92 are mounted on the opening-closing covering 45. The interlock component 91 is used to detect that the opening-closing covering 45 is closed.

Figure 4:
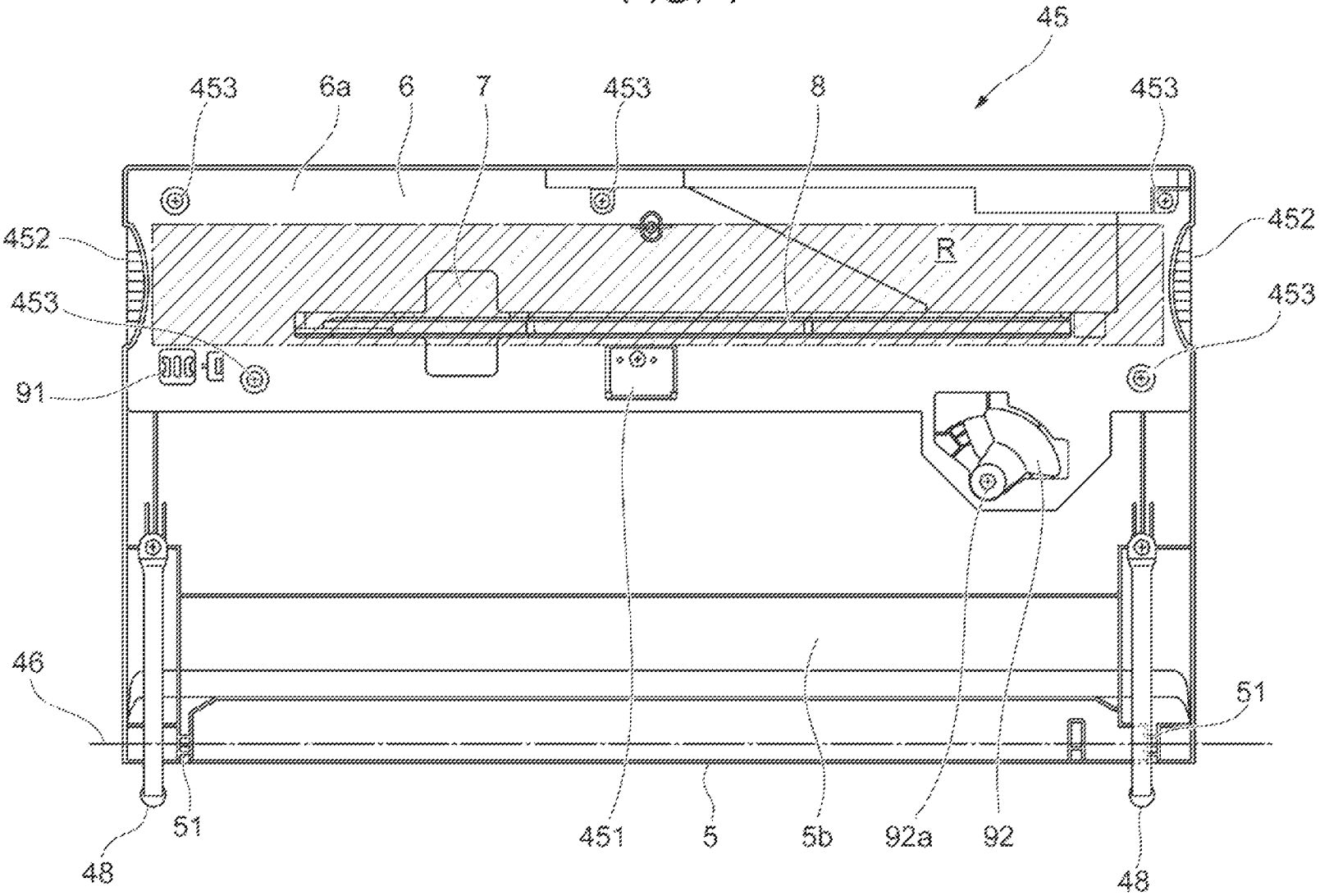
FIG. 4 illustrates a rear view of an opening-closing covering viewed in front of an inner side.

The hard key 92 is used to prevent the opening-closing covering 45 from being closed when the retracting operation is performed by using the rotation handle 24 and is rotatable about a rotation shaft 92*a* (see FIG. 4).

Configuration of Opening-Closing Covering 45

The configuration of the opening-closing covering 45 will now be described.

Figure 5A:
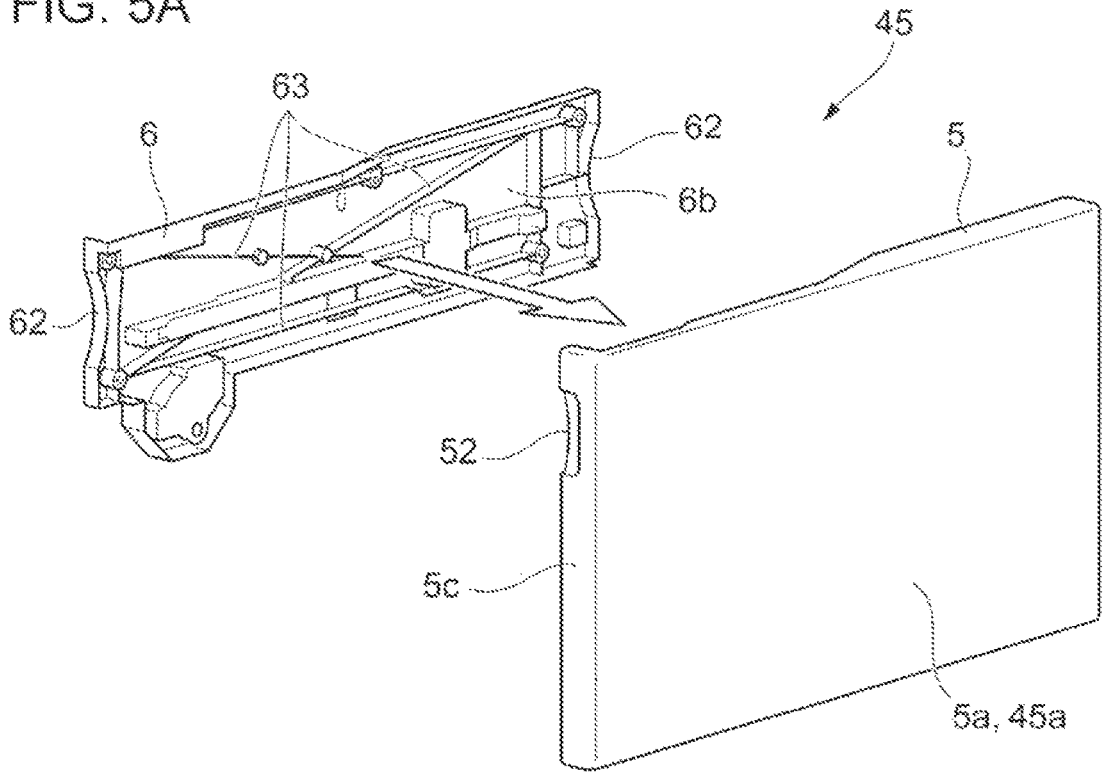
FIG. 5A and FIG. 5B illustrate the configuration of the opening-closing covering, where
Figure 5B:
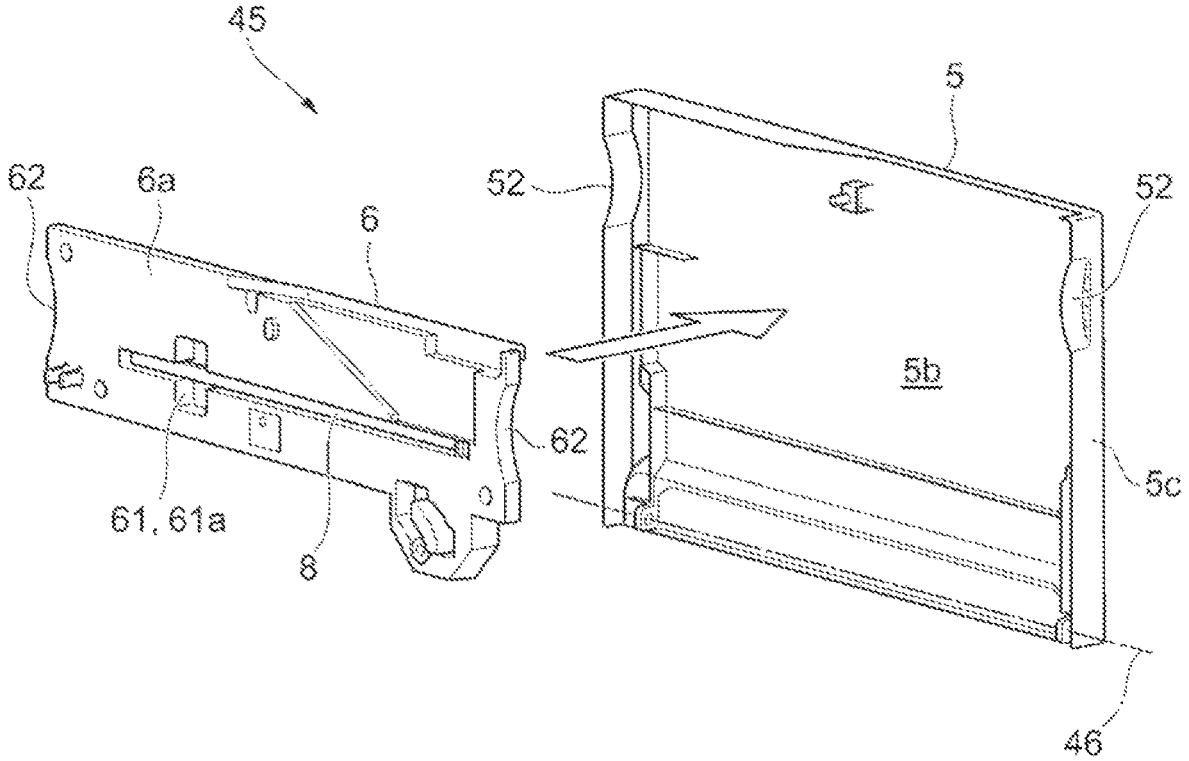

FIG. 4 illustrates a rear view of the opening-closing covering 45 viewed in front of an inner side. FIG. 5A and FIG. 5B illustrate the configuration of the opening-closing covering 45, where FIG. 5A illustrates an exploded perspective view of the opening-closing covering 45 viewed in front of an exterior covering 5, and FIG. 5B illustrates an exploded perspective view of the opening-closing covering 45 viewed in front of an interior covering 6.

As illustrated in FIG. 4, FIG. 5A, and FIG. 5B, the opening-closing covering 45 includes the exterior covering 5 that is located outward in the opening-closing covering 45 and the interior covering 6 that is located inward in the opening-closing covering 45. The interior covering 6 is screwed on the exterior covering 5 into an integrated body. Specifically, the interior covering 6 and the exterior covering 5 are assembled such that a back surface 6*b* of the interior covering 6 faces a back surface 5*b* of the exterior covering 5, and attachment screws 453 are inserted into a front surface 6*a* of the interior covering 6 as clear from an illustration of screw heads in FIG. 4. The total number of the attachment screws 453 is five. The attachment screws 453 are inserted in the internal threads of bosses 54 (see FIG. 7) that are formed in the back surface 5*b* of the exterior covering 5. The opening-closing covering 45 thus has a double structure of the exterior covering 5 and the interior covering 6.

As illustrated in FIG. 5A, a front surface 5*a* of the exterior covering 5 serves as a front surface 45*a* of the opening-closing covering 45. The front surface 5*a* of the exterior covering 5, that is, the front surface 45*a* of the opening-closing covering 45 configurates a part of the outer surface of the image forming apparatus 1 with the opening-closing covering 45 closed.

The exterior covering 5 is an example of an external opening-closing member. The back surface 5*b* of the exterior covering 5 is an example of an inner surface of the external opening-closing member. The interior covering 6 is an example of an internal opening-closing member.

Description of Exterior Covering 5

As illustrated in FIG. 4, the exterior covering 5 includes engagement portions 51 that are engaged with the housing 44 (see FIG. 3). The engagement portions 51 define the rotation center 46 described above. The rotation center 46 of the image forming apparatus 1 described above is near the exterior covering 5.

As illustrated in FIG. 5A, the exterior covering 5 includes side wall portions 5*c* that protrude from the front surface 5*a* toward the back surface 5*b*. Handle recessed portions 52 that are partly hollowed are formed on the side wall portions 5*c*. The handle recessed portions 52 correspond to the handles 452 of the opening-closing covering 45 illustrated in FIG. 4.

Description of Interior Covering 6

As illustrated in FIG. 5B, the interior covering 6 includes a containment recessed portion 61 that defines a containment space 61*a* that is hollowed from the front surface 6*a* toward the back surface 6*b* and that contains the cleaning rod 8 (see FIG. 4). The cleaning rod 8 is contained in the containment recessed portion 61 from the front surface 6*a* of the interior covering 6. The containment recessed portion 61 corresponds to the container 7 that is illustrated in FIG. 4 and that is described above.

The containment space 61*a* is an example of a containment space.

As illustrated in FIG. 5A and FIG. 5B, the interior covering 6 includes handle recessed portions 62 that are partly hollowed. The handle recessed portions 62 have shapes that follow the shapes of the handle recessed portions 52 of the exterior covering 5. As for the opening-closing covering 45, as illustrated in FIG. 4, the handle recessed portions 62 of the interior covering 6 are adjacent to the handle recessed portions 52 of the exterior covering 5.

As illustrated in FIG. 5A, the interior covering 6 includes reinforcement ribs 63 that protrude toward the exterior covering 5. The reinforcement ribs 63 are formed on the back surface 6*b* of the interior covering 6. In other words, the reinforcement ribs 63 are formed on the surface of the interior covering 6 that faces the exterior covering 5. The rigidity of the interior covering 6 may be increased by the reinforcement ribs 63.

The reinforcement ribs 63 are examples of a reinforcement rib.

The interior covering 6 is located inward in the opening-closing covering 45 as described above and is opened or closed together with the exterior covering 5. The interior covering 6 is located so as to connect the handles 452 of the opening-closing covering 45 illustrated in FIG. 4 to each other, more specifically, the handle recessed portions 52 illustrated in FIG. 5A and FIG. 5B to each other. That is, the handle recessed portions 62 of the interior covering 6 are located between a pair of the handle recessed portions 52 of the exterior covering 5 and receive a load when the handle recessed portions 62 are pressed inward.

In this way, the rigidity of the opening-closing covering 45 may be increased, and the opening-closing covering 45 may be inhibited from deforming due to an external force that acts on the handles 452 when the opening-closing covering 45 is opened.

The user readily opens the opening-closing covering 45 by using one hand by grabbing one of the pair of the handles 452.

As illustrated in FIG. 4, the containment recessed portion 61 of the interior covering 6 is nearer than the rotation center 46 to the handles 452 in an intersecting direction that intersects the rotation center 46. In other words, the position of the containment recessed portion 61 with the opening-closing covering 45 opened is away from the rotation center 46 and is near the user.

The configuration may be such that the containment recessed portion 61 is near the rotation center 46. According to the present exemplary embodiment, however, the cleaning rod 8 that is contained in the containment recessed portion 61 is readily taken out.

As illustrated in FIG. 4, at least a part of the containment recessed portion 61 is located in a region R (see a hatched region) that is interposed between the pair of the handles 452.

The configuration may be such that the containment recessed portion 61 is located in a region other than the region R. According to the present exemplary embodiment, however, the rigidity of the handles 452 may be increased by using an uneven shape of the containment recessed portion 61 even when there is no rib.

The interior covering 6 will be further described. As illustrated in FIG. 4, the interior covering 6 is biasedly located at a position away from the rotation center 46 toward the handles 452 in the intersecting direction. To increase the rigidity of the opening-closing covering 45, the configuration may be such that the dimension of the interior covering 6 in the intersecting direction is equal to that of the exterior covering 5. According to the present exemplary embodiment, however, the amount of the material of the interior covering 6 may be decreased by decreasing the size of the interior covering 6.

Description of Cleaning Rod 8

Figure 6:
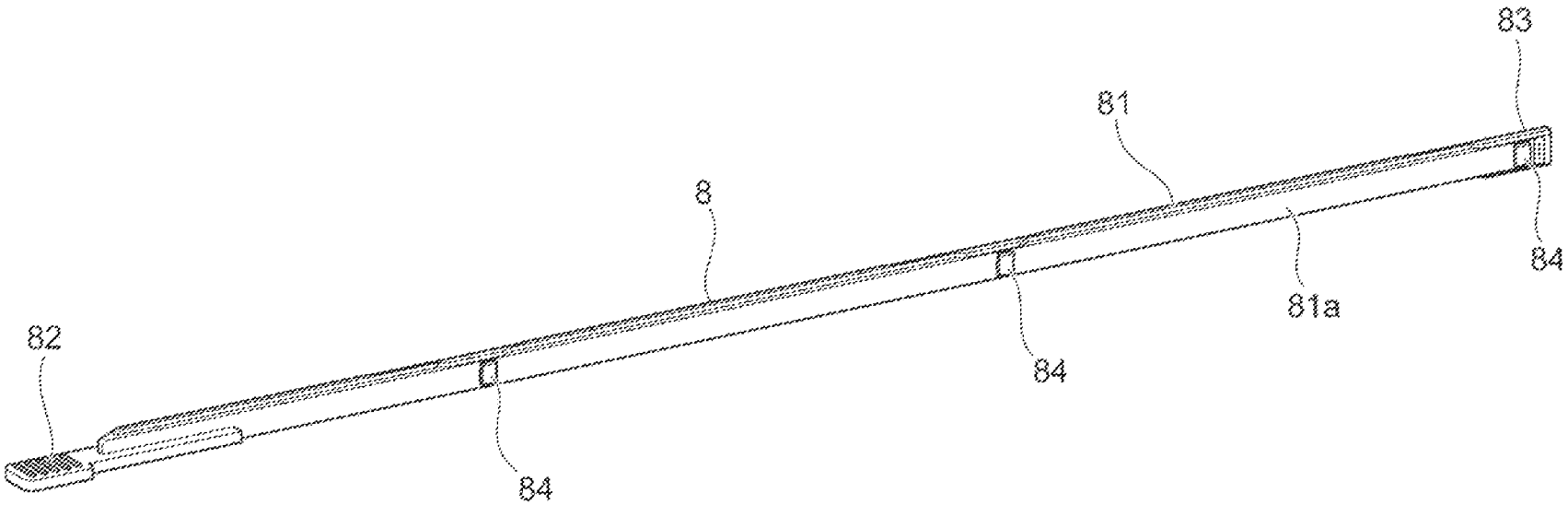
FIG. 6 illustrates a perspective view of a cleaning rod.

FIG. 6 illustrates a perspective view of the cleaning rod 8.

As illustrated in FIG. 6, the cleaning rod 8 includes an elongated portion 81 that has a flat surface 81*a* and that has a long shape, a grip portion 82 that is formed at a first end portion of the elongated portion 81, a second end portion 83 of the elongated portion 81, and cleaning members 84 that are disposed on the flat surface 81*a* of the elongated portion 81 and that are composed of non-woven fabric.

According to the present exemplary embodiment, the cleaning members 84 are not disposed along the elongated portion 81 but are disposed at three positions including a position on the second end portion 83 at intervals.

Configuration of Exterior Covering 5

Figure 7:
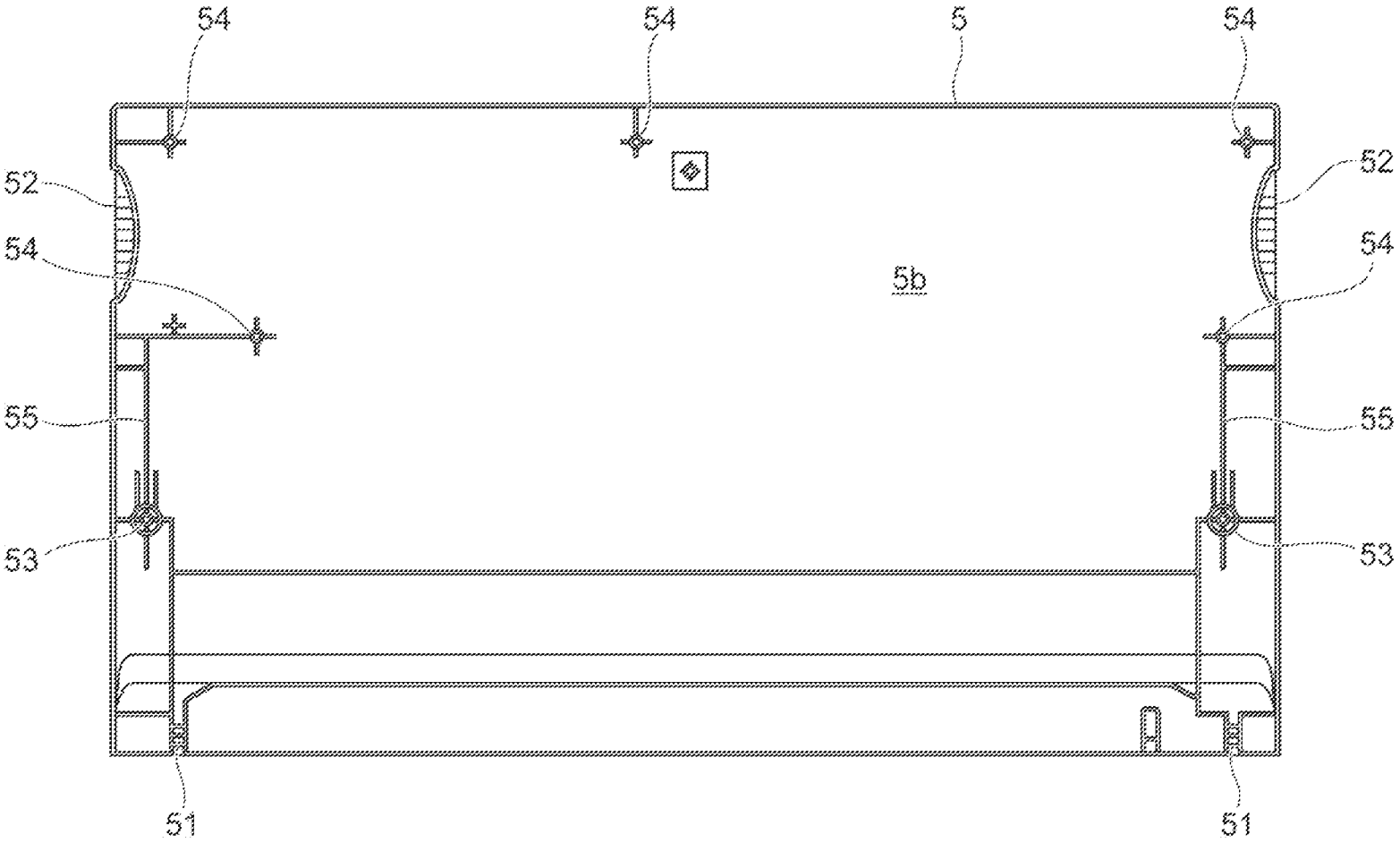
FIG. 7 illustrates a rear view of the exterior covering viewed in front of a back surface.

FIG. 7 illustrates a rear view of the exterior covering 5 viewed in front of the back surface 5*b*.

As illustrated in FIG. 7, the exterior covering 5 includes strap-mounting portions 53 on the back surface 5*b* for mounting end portions of the straps 48 (see FIG. 4). The exterior covering 5 has the bosses 54 on the back surface 5*b* for mounting the interior covering 6 as described above.

The exterior covering 5 also includes reinforcement ribs 55 on the back surface 5*b*, and the reinforcement ribs 55 connect the strap-mounting portions 53 and the bosses 54 to each other for reinforcement.

The strap-mounting portions 53, the bosses 54, and the reinforcement ribs 55 are located on the back surface 5*b* of the exterior covering 5 not at a central portion but at circumferential portions.

When there is a risk of the appearance of sunken marks on the circumferential portions of the exterior covering 5, texturing processing may be performed on the circumferential portions, that is, wrinkle marks may be formed thereon.

Configuration of Interior Covering 6

Figure 8A:
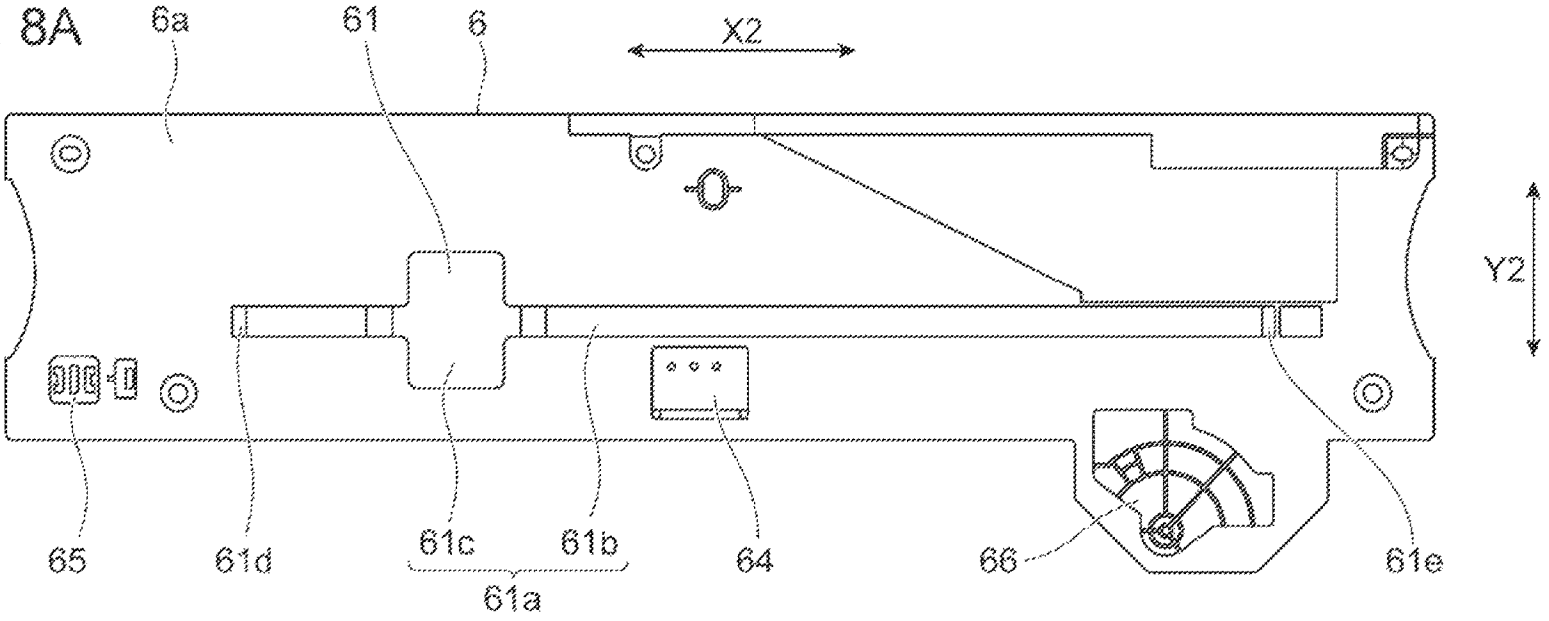
FIG. 8A, FIG. 8B, and FIG. 8C illustrate the interior covering viewed in front of a front surface, where
Figure 8C:
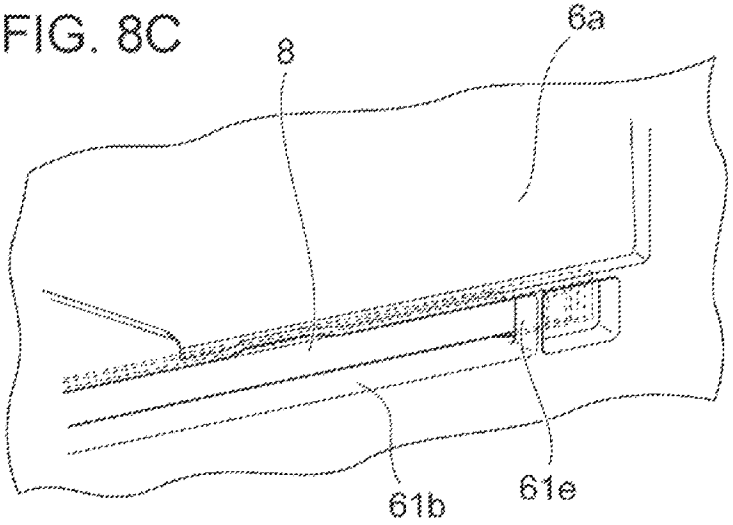
Figure 8B:
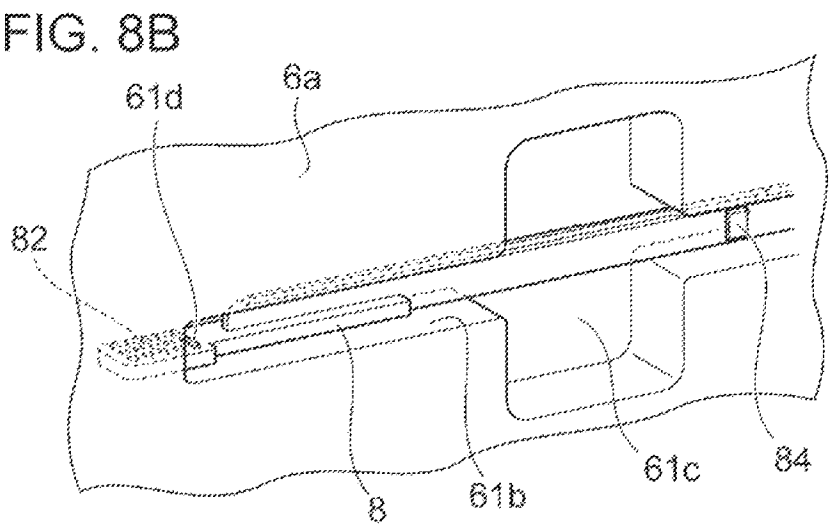
Figure 9:
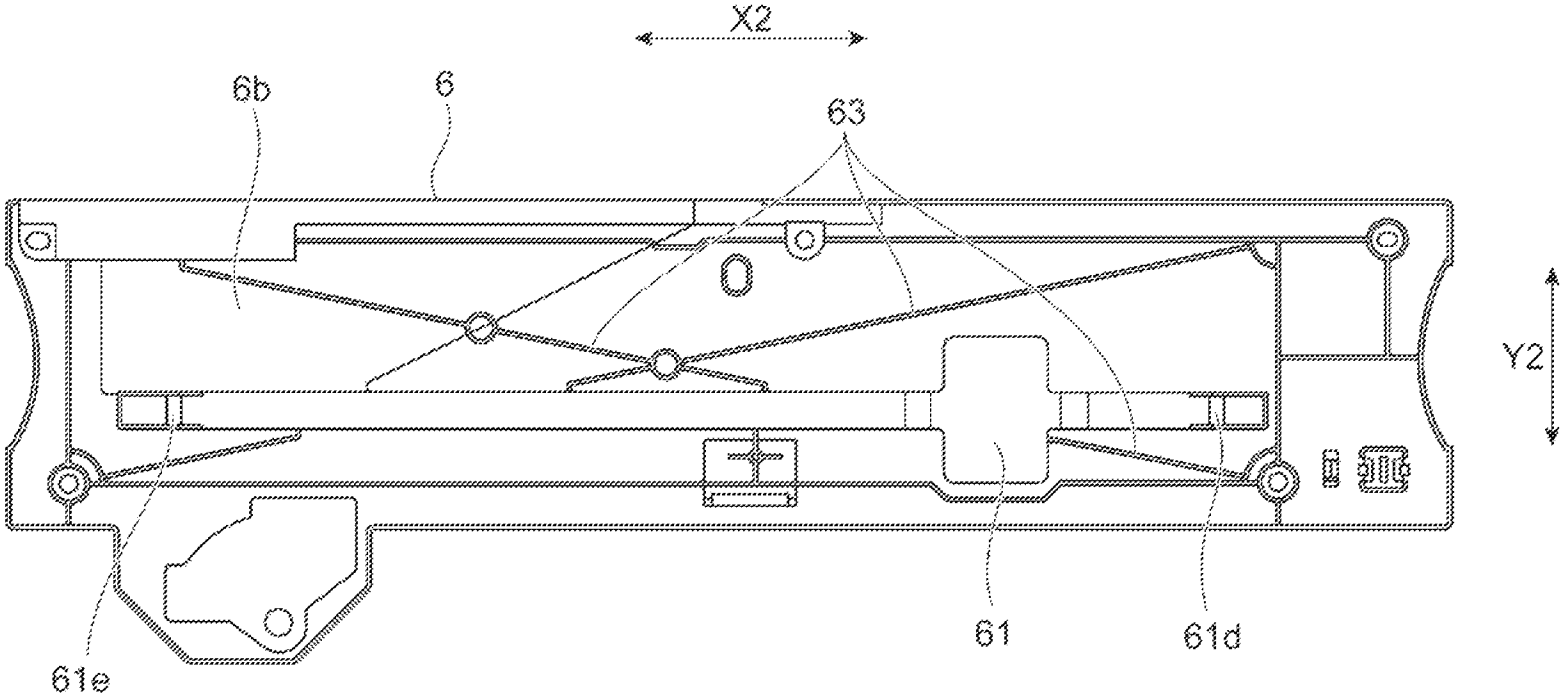
FIG. 9 illustrates a rear view of the interior covering viewed in front of a back surface.

FIG. 8A, FIG. 8B, and FIG. 8C illustrate the interior covering 6 viewed in front of the front surface 6*a*, where FIG. 8A illustrates a front view, and FIG. 8B and FIG. 8C illustrate enlarged perspective views of parts in FIG. 8A. More specifically, FIG. 8B illustrates an enlarged perspective view of the vicinity of a notch portion 61*d* and the cleaning rod 8. FIG. 8C illustrates an enlarged perspective view of the vicinity of a notch portion 61*e* and the cleaning rod 8. FIG. 9 illustrates a rear view of the interior covering 6 viewed in front of the back surface 6*b*.

As illustrated in FIG. 8A and FIG. 9, the interior covering 6 has a longitudinal direction X2 and a transverse direction Y2, and the containment recessed portion 61 is formed by using the longitudinal direction X2. An elongated member may be contained therein.

The longitudinal direction X2 is the same as the direction in which the rotation center 46 (see, for example, FIG. 3) extends. The transverse direction Y2 is the same as the direction that intersects the rotation center 46, or the intersecting direction.

The longitudinal direction X2 is an example of a longitudinal direction. The transverse direction Y2 is an example of a transverse direction.

As illustrated in FIG. 8A, the containment space 61*a* of the containment recessed portion 61 is configurated so as to include a first containment space 61*b* that follows the shape of the cleaning rod 8 (see FIG. 6) and a second containment space 61*c* that is used to contain or take out the cleaning rod 8. The first containment space 61*b* is formed so as to extend in the longitudinal direction X2. The second containment space 61*c* widely extends in the transverse direction Y2 at an intermediate position on the first containment space 61*b*. More specifically, the second containment space 61*c* is located away from the center of the first containment space 61*b* toward an end portion.

The bottom surface of the second containment space 61*c* is located at a position deeper than that of the bottom surface of the first containment space 61*b*. The cleaning rod 8 may be pinched when the cleaning rod 8 is taken out, and the cleaning rod 8 is readily taken out.

As illustrated in FIG. 8A and FIG. 9, the containment recessed portion 61 includes the notch portions 61*d* and 61*e* at both end portions of the first containment space 61*b*. A length between the notch portion 61*d* and the notch portion 61*e* is shorter than the total length of the cleaning rod 8. For this reason, as illustrated in FIG. 8B and FIG. 8C, both end portions of the cleaning rod 8 that are inserted into the first containment space 61*b* of the containment space 61*a* from the front surface 6*a* pass through the notch portions 61*d* and 61*e* and are located nearer than the front surface 6*a* to the opposite surface (the back surface 6*b*). That is, the cleaning rod 8 is contained in the containment recessed portion 61 in a manner in which while the cleaning rod 8 is bent, the grip portion 82 passes through the notch portion 61*d*, and the second end portion 83 passes through the notch portion 61*e*.

In this way, the cleaning rod 8 may be prevented from falling from the first containment space 61*b* without another member that presses the cleaning rod 8 that is contained in the containment recessed portion 61. Also, in this way, the cleaning rod 8 may be readily contained and taken out.

In FIG. 8B, the cleaning rod 8 is contained in the containment recessed portion 61 such that the cleaning members 84 composed of non-woven fabric are visible but is not limited to this posture. The degree of dirt on the cleaning members 84 may be made readily checkable by using the posture illustrated in FIG. 8B, but there is a risk of a toner stain due to an opening or closing operation of the opening-closing covering 45. The toner stain due to the opening or closing operation of the opening-closing covering 45 may be reduced in a manner in which the cleaning rod 8 is contained in a posture in which the cleaning members 84 composed of non-woven fabric are not visible, although the degree of dirt on the cleaning members 84 is not checkable by merely opening the opening-closing covering 45.

The reinforcement ribs 63 are formed on the back surface 6*b* of the interior covering 6 as described above and extend in directions that differ from the longitudinal direction X2, that is, directions that intersect the longitudinal direction X2 as illustrated in FIG. 9. The interior covering 6 may be more effectively inhibited from being twisted due to an external force, and the rigidity may be increased by using the reinforcement ribs 63 according to the present exemplary embodiment more than the case where the reinforcement ribs 63 extend in the longitudinal direction X2.

As illustrated in FIG. 8A, the interior covering 6 includes, on the front surface 6*a*, a mounting portion 64 for mounting the iron plate member 451, a mounting portion 65 for mounting the interlock component 91, and a mounting portion 66 for mounting the hard key 92.

Description of Hard Key 92

Figure 10A:
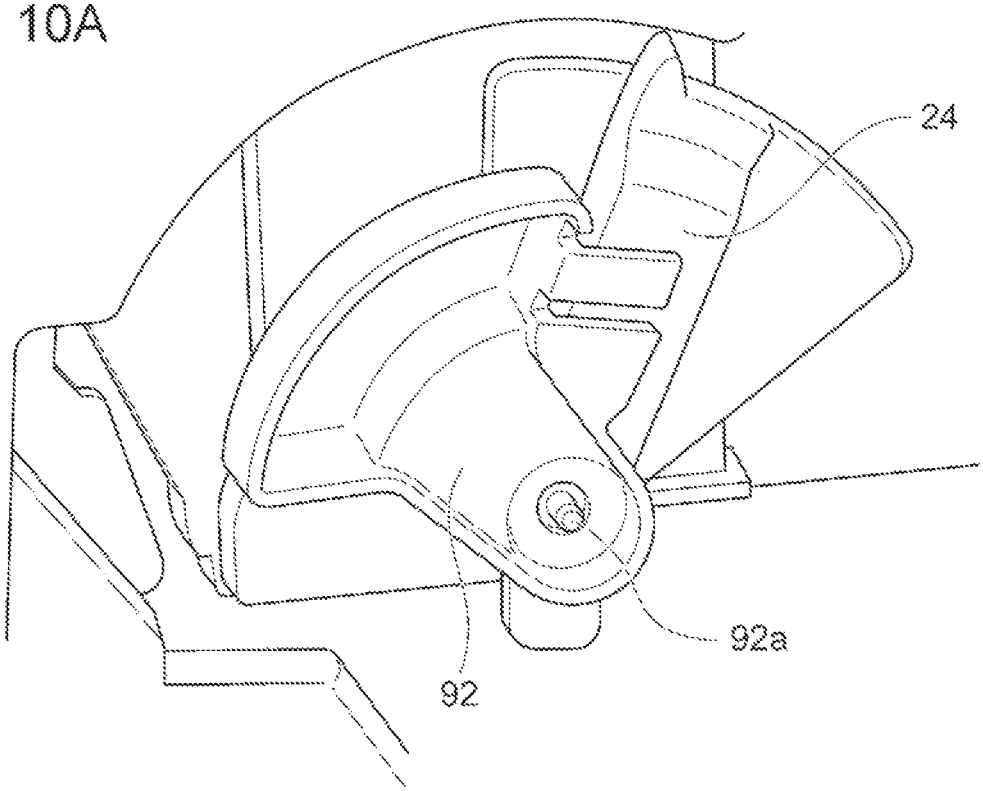
FIG. 10A and FIG. 10B illustrate the function of a hard key, where
Figure 10B:
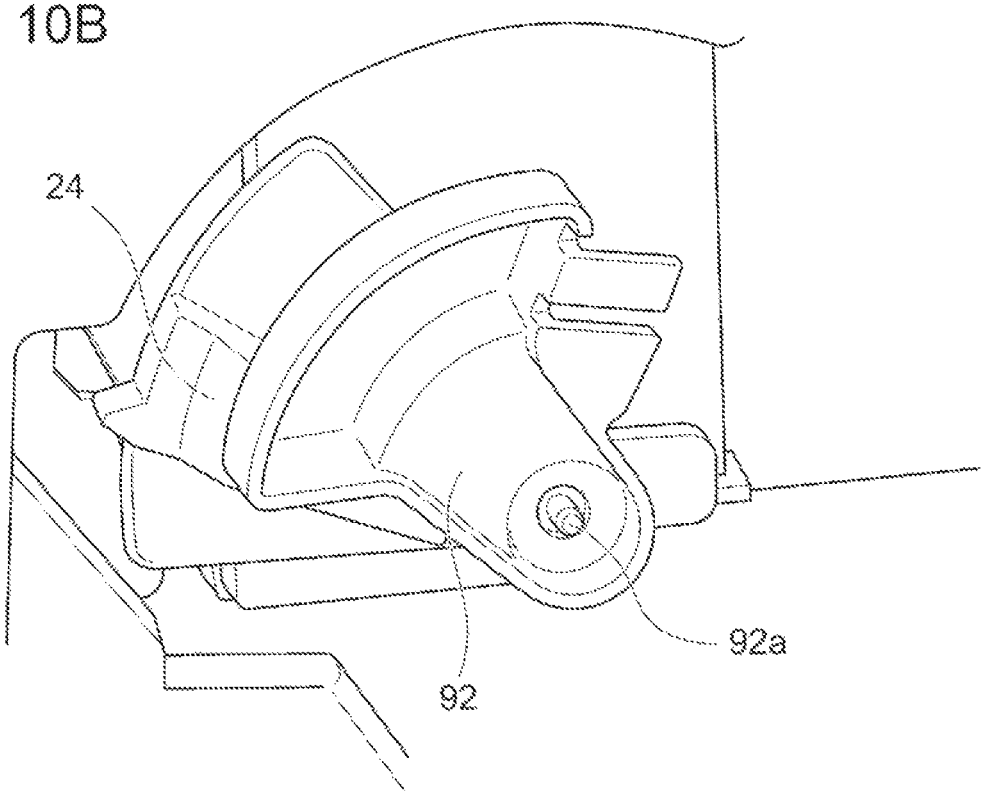

FIG. 10A and FIG. 10B illustrate the function of the hard key 92, where FIG. 10A illustrates a state in which the hard key 92 does not interfere with the rotation handle 24, and FIG. 10B illustrates a state in which the hard key 92 interferes with the rotation handle 24. In FIG. 10A and FIG. 10B, an illustration of the opening-closing covering 45 is omitted for convenience of description.

The hard key 92 is mounted on the opening-closing covering 45 as described above, and the rotation handle 24 is mounted on the image forming member 10 (see FIG. 1) in the apparatus.

In the case where the retracting operation is not performed by using the rotation handle 24, as illustrated in FIG. 10A, the hard key 92 does not interfere with the rotation handle 24 when the opening-closing covering 45 is tried to stand upright, and the opening-closing covering 45 is closed.

In the case where the retracting operation is performed by using the rotation handle 24, as illustrated in FIG. 10B, the hard key 92 overlaps the rotation handle 24 in a depth direction (the Z1 direction in FIG. 2A and FIG. 2B) and interferes with the rotation handle 24 even when the opening-closing covering 45 is tried to stand upright, and the opening-closing covering 45 is not closable. In this way, the image forming apparatus may be prevented from operating with the opening-closing covering 45 closed during retracting.

The retracting operation is performed when the image forming apparatus 1 is shipped as a product, and an influence such as vibrations and shakes during transportation is reduced. In this case, the hard key 92 is mounted by using the rotation shaft 92*a* such that the position of the hard key 92 is changeable with respect to the opening-closing covering 45, so that the hard key 92 does not interfere with the rotation handle 24 when the opening-closing covering 45 is closed during shipment of the product even in the case where the retracting operation is performed.

Meanings of Double Structure for Opening-Closing Covering 45

The meanings of the double structure of the exterior covering 5 and the interior covering 6 for the opening-closing covering 45 will now be described. There are the meanings as described below.

First Meaning

In the existing cases, a reinforcement rib is provided to increase the rigidity of an exterior covering. In some cases, however, appearance is detracted due to a sink mark that appears on a surface of the exterior covering. The use of the exterior covering that has the detracted appearance unintentionally leads to poor product quality.

In view of this, according to the present exemplary embodiment, the interior covering 6 includes the container that protrudes toward the exterior covering 5 to define the containment space, and the interior covering 6 is mounted on the exterior covering 5 to form the opening-closing covering 45 that has the double structure.

In addition, the interior covering 6 may include the reinforcement ribs 63 to serve as a structural member, and the exterior covering 5 may include, for example, no reinforcement ribs to serve as a dressed member. In the case where the reinforcement ribs 55 and the bosses 54 are provided, the positions of the reinforcement ribs are not at the central portion but at the circumferential portions.

Second Meaning

The exterior covering is a member that is opened or closed during the maintenance. For example, in the case where the exterior covering is used for the electrophotographic image forming apparatus, a reinforcement rib that is located at a portion at which the toner is cleaned makes it difficult to clean the toner. In view of this, according to the present exemplary embodiment, the reinforcement ribs are not disposed on the surface of the opening-closing covering 45 that faces the housing 44 of the image forming apparatus 1 but are disposed on the surface of the interior covering 6 that faces the exterior covering 5. This makes it easy to clean the toner while the rigidity is increased.

Third Meaning

In some cases, the configuration of an exterior covering is changed in accordance with a product specification, and the exterior covering is mounted on a completed product. In this case, the exterior covering is not shared. Accordingly, it is necessary for the exterior covering to be individually designed and manufactured for every product specification and to be managed as a stock, it is necessary to make and manage a production manual, and it is difficult to reduce manufacturing costs.

The image forming apparatus 1 according to the present exemplary embodiment includes the four image forming units 11Y, 11M, 11C, and 11K and is configurated so as to form a color image by using the yellow (Y), the magenta (M), the cyan (C), the black (K) toner images (see FIG. 1) but is not limited thereto. The image forming apparatus 1 may be configurated so as to include the single image forming unit 11K and so as to form a monochrome image by using the black (K) toner image.

In the case where the shape of the rotation handle 24 that performs the retracting operation and that is described above differs between the configuration (also referred to below as a color image formation configuration") that includes the four image forming units 11Y, 11M, 11C, and 11K and the configuration (also referred to below as a "monochrome image formation configuration") that includes only the single image forming unit 11K, the shape of the hard key 92 that interferes with the rotation handle 24 differs therebetween. In some cases, the length of the cleaning rod 8 (see, for example, FIG. 5A and FIG. 5B) differs between the color image formation configuration and the monochrome image formation configuration.

Two kinds of design manufacturing and stock management, for example, are needed to deal with a component the shape of which differs between the color image formation configuration and the monochrome image formation configuration.

In the case where the image forming apparatus 1 is manufactured as another brand product, an appearance design is made based on the specification of the other brand, an exterior component of the image forming apparatus 1 is changed for every appearance design in some cases. Accordingly, the number of combinations produced from the difference in the appearance design and the difference between color and monochrome described above is large, and it is difficult to reduce the manufacturing costs because of design manufacturing and stock management needed for every combination.

In view of this, according to the present exemplary embodiment, two kinds of the interior covering 6 are prepared for the color image formation configuration and the monochrome image formation configuration, and the exterior covering 5 is changeable depending on the appearance design to deal with multiple kinds of the opening-closing coverings 45.

More specifically, the shape of the mounting portion 66 (FIG. 8A) of the interior covering 6 differs between the color image formation configuration and the monochrome image formation configuration. In the case where the length of the cleaning rod 8 (see, for example, FIG. 5A and FIG. 5B) that is contained in the containment recessed portion 61 of the interior covering 6 differs between the color image formation configuration and the monochrome image formation configuration, the shape of the containment recessed portion 61 (FIG. 8A) of the interior covering 6 differs therebetween. In view of this, two kinds of the interior covering 6 are prepared for the color image formation configuration and the monochrome image formation configuration.

The exterior covering 5 that is located at the front of the image forming apparatus 1 is not affected by the difference between the color image formation configuration and the monochrome image formation configuration and is changeable depending on the appearance design.

In this way, the kinds of the interior covering 6 are classified by the internal configuration or performance of the apparatus, and the exterior covering 5 is individually designed and manufactured depending on the appearance design. In addition to this, the configuration is such that the interior covering 6 and the exterior covering 5 are screwed on each other to manufacture the opening-closing covering 45 for dealing with a small amount and multiple kinds of products.

Various Modifications

Various modifications to the image forming apparatus 1 according to the present exemplary embodiment are considered below. Examples of the various modifications will now be described.

Figure 11:
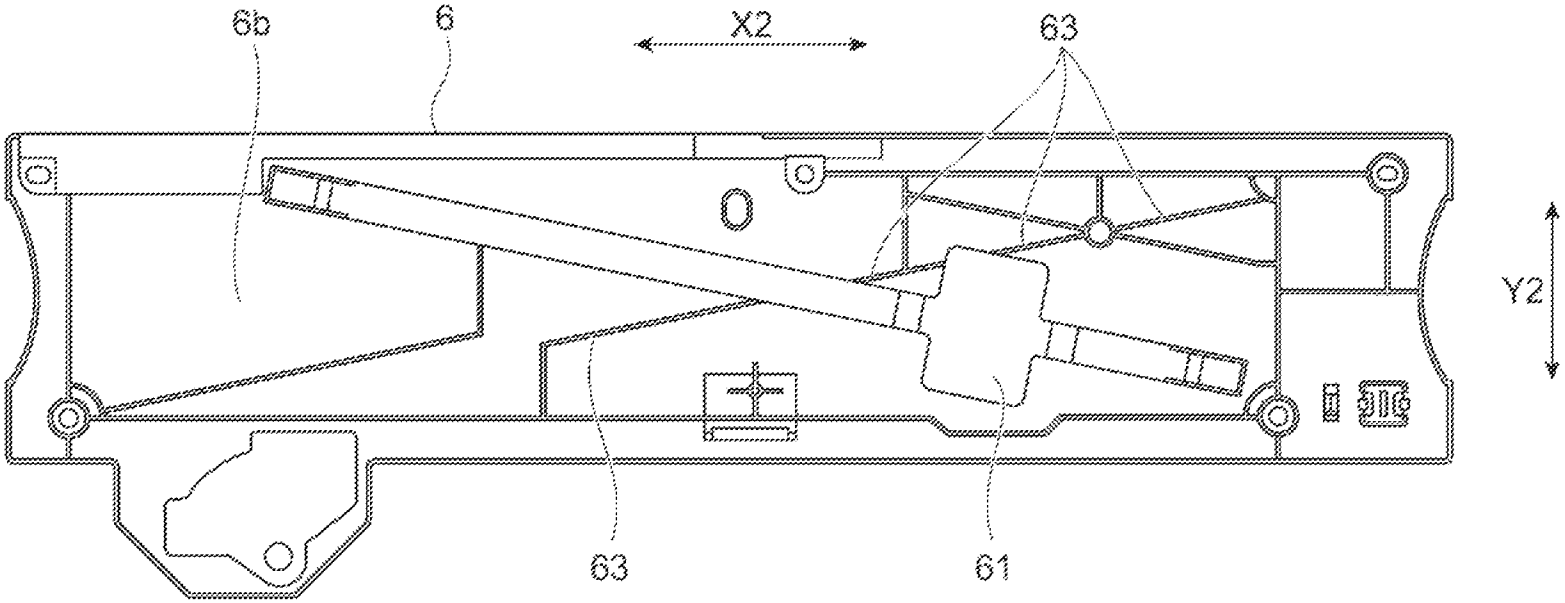
FIG. 11 illustrates a rear view of the interior covering for description of a containment recessed portion according to a modification.

FIG. 11 illustrates a rear view of the interior covering 6 for description of the containment recessed portion 61 according to a modification, illustrates the interior covering 6 viewed in front of the back surface 6*b*, and corresponds to FIG. 9 according to the present exemplary embodiment.

The containment recessed portion 61 illustrated in FIG. 11 extends in a direction that differs from the longitudinal direction X2. That is, the containment recessed portion 61 according to the modification differs from the present exemplary embodiment in which the containment recessed portion 61 extends in the longitudinal direction X2 in that the containment recessed portion 61 extends in the direction that intersects the longitudinal direction X2.

As illustrated in FIG. 11, the reinforcement ribs 63 extend in a direction that intersects the longitudinal direction X2, and the containment recessed portion 61 is located between the reinforcement ribs 63. In this case, the containment recessed portion 61 may function as a reinforcement rib, and the amount of a molding material may be reduced by omitting the reinforcement rib.

As illustrated in FIG. 11, the direction in which the reinforcement ribs 63 extend is not the same as the direction in which the containment recessed portion 61 extends. However, the direction in which the reinforcement ribs 63 extend may be the same as the direction in which the containment recessed portion 61 extends.

Figure 12:
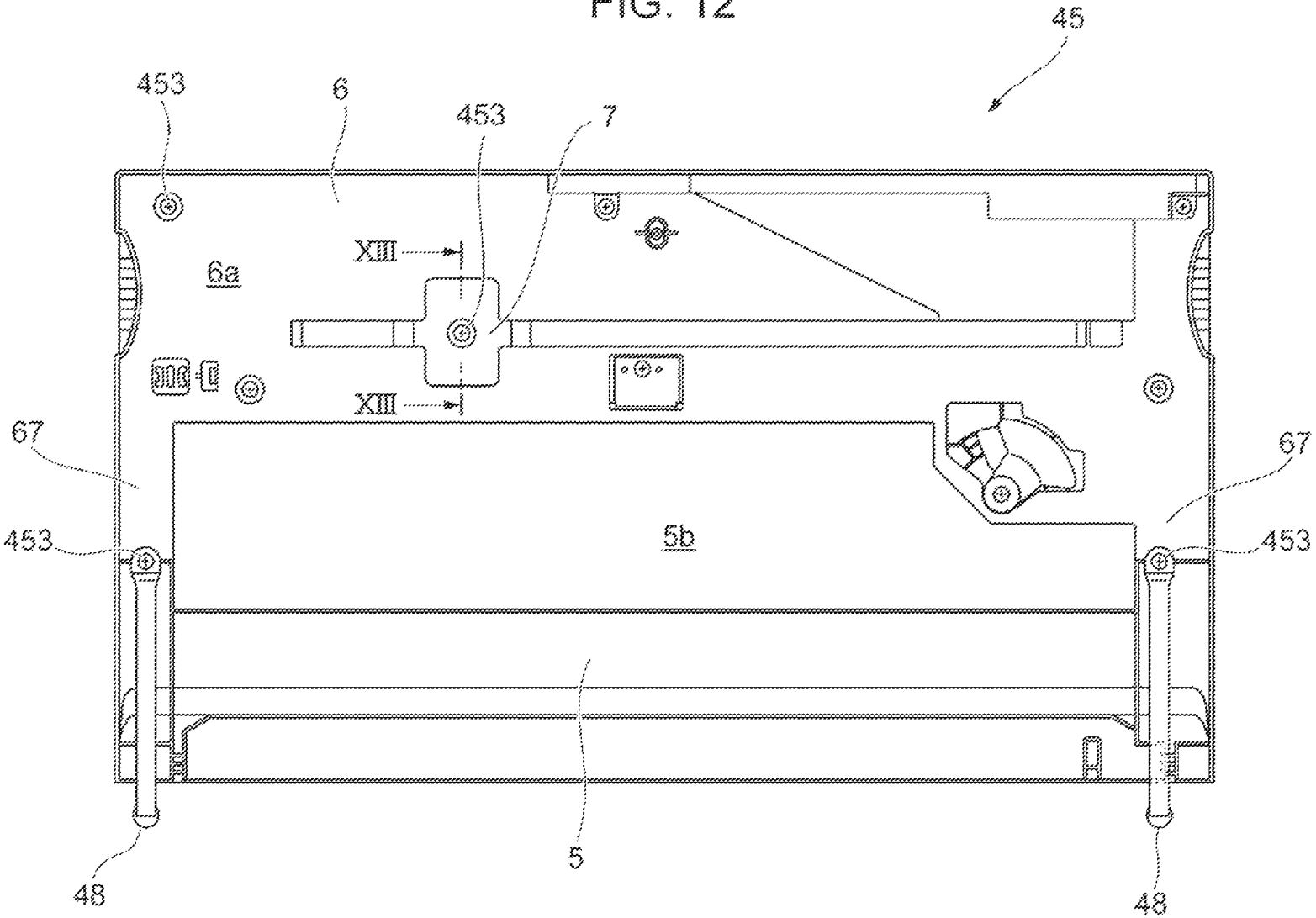
FIG. 12 illustrates a rear view of the opening-closing covering according to the modification.
Figure 13:
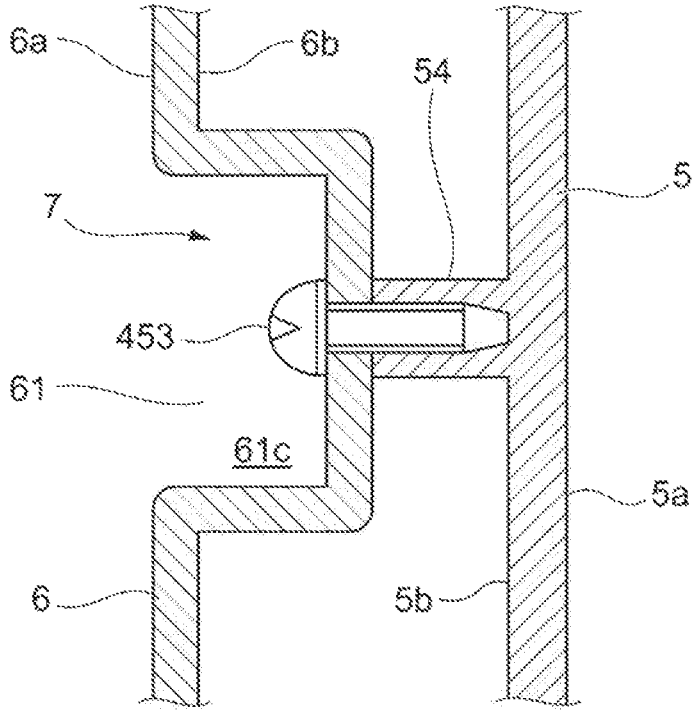
FIG. 13 illustrates a sectional view taken along line XIII-XIII in FIG. 12.

FIG. 12 illustrates a rear view of the opening-closing covering 45 according to a modification and corresponds to FIG. 4 according to the present exemplary embodiment. FIG. 13 is a sectional view taken along line XIII-XIII in FIG. 12.

As illustrated in FIG. 12, the opening-closing covering 45 according to the modification differs from that according to the present exemplary embodiment in a structure in which the straps 48 are mounted. That is, the modification differs from the present exemplary embodiment in which the straps 48 are mounted on the exterior covering 5 in that the straps 48 are mounted on the interior covering 6.

More specifically, the interior covering 6 illustrated in FIG. 12 includes extensions 67 that extend to positions at which the straps 48 are mounted. In this case, it is not necessary for the exterior covering 5 to include the strap-mounting portions 53 (see FIG. 7) for mounting the straps 48. The straps 48 may be more firmly mounted on the opening-closing covering 45 by using the structure in which the straps 48 are mounted on the interior covering 6 that has rigidity higher than that of the exterior covering 5.

As illustrated in FIG. 13, the second containment space 61*c* of the containment recessed portion 61 that protrudes from the interior covering 6 toward the exterior covering 5 is in contact with the exterior covering 5. At this position, the exterior covering 5 and the interior covering 6 are secured to each other by using the attachment screw 453. That is, the configuration according to the modification is such that the bottom surface of the containment recessed portion 61 is in contact with the boss 54 of the exterior covering 5 and is screwed.

In this way, the exterior covering 5 may be reinforced by the interior covering 6.

The position of screwing is not on the circumferential portions of the interior covering 6 unlike those of the other attachment screws 453 (see FIG. 4). In this case, the distance between the attachment screws 453 decreases, and the exterior covering 5 and the interior covering 6 are more firmly combined together with the other attachment screws 453. The number of the attachment screws 453 may be reduced while the necessary rigidity is maintained by using this screwing configuration. Workability for assembling the opening-closing covering 45 may be improved by using this screwing configuration.

The second containment space 61*c* is an example of a portion that protrudes toward the external opening-closing member.

The structure illustrated in FIG. 13 is described as the modification but may be used for the present exemplary embodiment.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An opening-closing member of an image forming apparatus, the opening-closing member comprising:

an external opening-closing member that configurates a part of an outer surface of the image forming apparatus and that is openable and closable;

an internal opening-closing member that faces an inner surface of the external opening-closing member and that is openable and closable together with the external opening-closing member; and a container that defines a containment space by protruding from the internal opening-closing member toward the external opening-closing member and that enables a member contained in the containment space to be taken out when the external opening-closing member and the internal opening-closing member are opened, wherein the internal opening-closing member extends between and contacts handle portions that are used by a user when the internal opening-closing member and the external opening-closing member are opened.

2. The opening-closing member according to claim 1, wherein the internal opening-closing member has a longitudinal direction and a transverse direction, and wherein the container is formed by using the longitudinal direction of the internal opening-closing member.

3. The opening-closing member according to claim 2, wherein the container is formed such that the containment space extends in the longitudinal direction.

4. The opening-closing member according to claim 2, wherein a reinforcement rib that protrudes from the internal opening-closing member toward the external opening-closing member is formed in an intersecting direction that intersects the longitudinal direction, and wherein the container is formed such that the containment space extends in the intersecting direction.

5. The opening-closing member according to claim 4, wherein the containment space of the container is located between a plurality of the reinforcement ribs.

6. The opening-closing member according to claim 1, wherein a portion that protrudes toward the external opening-closing member and that defines the containment space of the container is in contact with the external opening-closing member.

7. The opening-closing member according to claim 1, wherein the container is nearer than a rotation center about which the external opening-closing member and the internal opening-closing member are opened or closed to handle portions that are used by a user when the external opening-closing member and the internal opening-closing member are opened.

8. The opening-closing member according to claim 7, wherein at least a portion of the container is located in a range in which the handle portions that are used by the user are connected to each other.

9. The opening-closing member according to claim 7, wherein the internal opening-closing member is located at a position away from the rotation center toward the handle portions that are used by the user.

10. The opening-closing member according to claim 1, further comprising:

a restriction member that has a first end mounted on the internal opening-closing member and a second end mounted on the image forming apparatus and that restricts an opening degree of the internal opening-closing member relative to the image forming apparatus when the internal opening-closing member is opened.

11. An opening-closing member of an image forming apparatus, the opening-closing member comprising:

an external opening-closing member that is openable and closable relative to the image forming apparatus, that is opened during maintenance, and that has a surface that serves as an outer surface of the image forming apparatus; and an internal opening-closing member that is located inside the external opening-closing member, that is opened or closed together with the external opening-closing member, and that is located so as extend between and contact handle portions of the external opening-closing member that are used by a user when the external opening-closing member is opened.

12. An image forming apparatus comprising:

an image forming member that forms an image;

an external opening-closing member that is openable and closable relative to the image forming member, that is opened during maintenance, and that has a surface that serves as an apparatus outer surface; and an internal opening-closing member that is located inside the external opening-closing member, that is opened or closed together with the external opening-closing member, and that is located so as to extend between and contact handle portions of the external opening-closing member that are used by a user when the external opening-closing member is opened.

* * * * *